United States Patent [19]

Papanicolaou et al.

[11] 3,948,406

[45] Apr. 6, 1976

[54] STORAGE TANKS, PARTICULARLY FOR LIQUIFIED GASES

[75] Inventors: John Paul Papanicolaou, Athens, Greece; Telemachus Nicolas Galatis, London, England

[73] Assignee: Marine and Industrial Developments Limited, Piraeus, Greece

[22] Filed: Aug. 1, 1973

[21] Appl. No.: 384,748

[30] Foreign Application Priority Data

Aug. 10, 1972 United Kingdom ..... 37452/72

[52] U.S. Cl. ..... 220/9 F; 220/1 B; 220/9 LG; 220/9 M; 220/63 R

[51] Int. Cl.[2] ..... B65D 25/18; B65D 25/14

[58] Field of Search ..... 220/9 LG, 9 F, 9 M, 9 G, 220/1 B, 63 R

[56] References Cited

UNITED STATES PATENTS

| | | | |
|---|---|---|---|
| 2,521,080 | 9/1950 | Morrison | 220/9 M |
| 2,859,895 | 11/1958 | Beckwith | 220/9 LG |
| 2,889,953 | 6/1959 | Morrison | 220/9 LG |
| 3,317,074 | 5/1967 | Barker, Jr. et al. | 220/9 F |
| 3,367,527 | 2/1968 | Darlington | 220/9 F |
| 3,655,086 | 4/1972 | Trenner | 220/9 LG |
| 3,671,315 | 6/1972 | Iarossi | 220/9 LG |
| 3,717,005 | 2/1973 | McGrew et al. | 220/9 LG |
| 3,765,558 | 10/1973 | Withers | 220/9 LG |
| 3,773,604 | 11/1973 | Desai et al. | 220/9 LG |
| 3,777,501 | 12/1973 | Sharp et al. | 220/9 LG |

FOREIGN PATENTS OR APPLICATIONS

| | | | |
|---|---|---|---|
| 861,310 | 1/1971 | Canada | 220/9 LG |

*Primary Examiner*—William Price
*Assistant Examiner*—Joseph M. Moy
*Attorney, Agent, or Firm*—Cushman, Darby & Cushman

[57] ABSTRACT

A storage container for storing substance, particularly liquefied gas, at sub-zero temperatures and atmospheric pressure is provided with a thermally insulating lining incorporating a fluid-impervious primary barrier which forms an integral part of a unitary cellular matrix secured to the structural shell of the container. The matrix cells are occupied by thermally insulating load-bearing material. The unitary cellular matrix sustains the tensile forces imposed due to thermal contraction when the interior of the container is cooled.

A method of forming the lining involves the use of thermally insulating blocks individually encapsulated in skins of a synthetic elastomer and the bonding of the blocks together so that their skins are integrated to form a unitary cellular matrix enclosing the insulating blocks.

8 Claims, 6 Drawing Figures

FIG.6
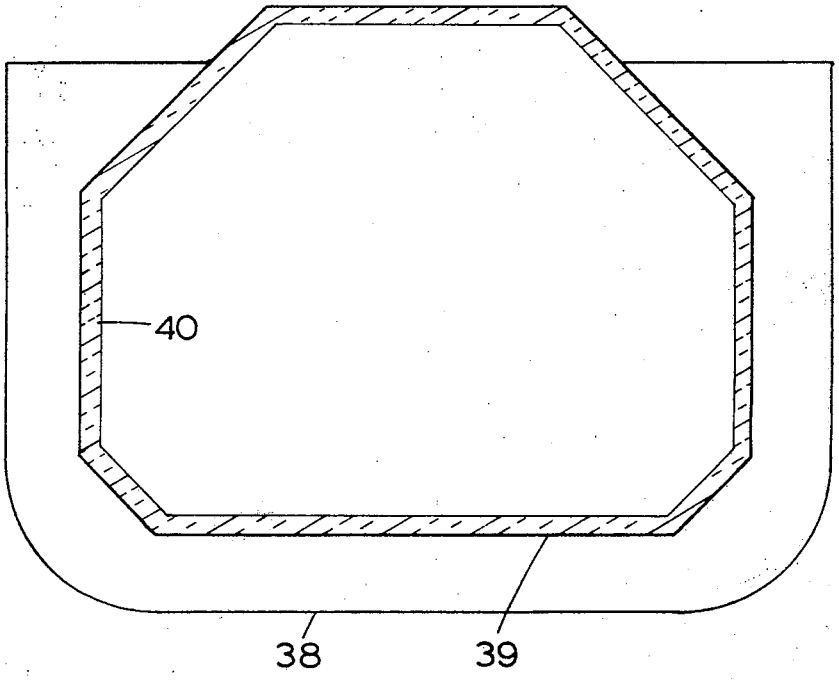
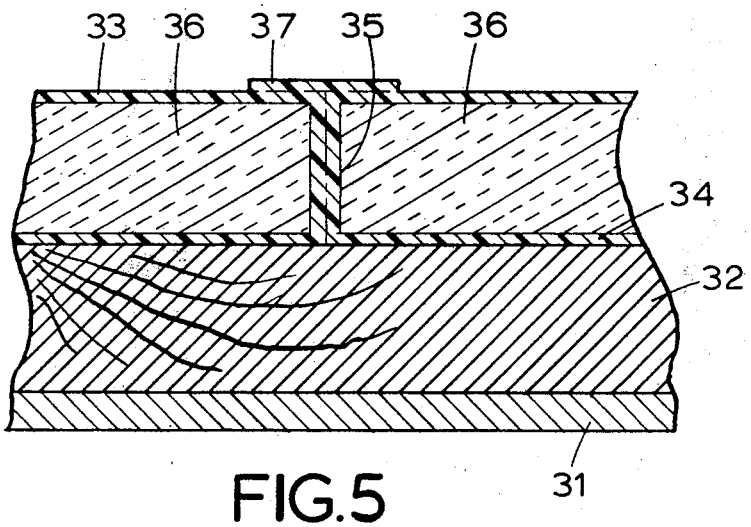
FIG.5

STORAGE TANKS, PARTICULARLY FOR LIQUIFIED GASES

This invention relates to containers for storing substances at sub-zero temperatures, said containers comprising a structural shell having a lining incorporating thermally insulating material and a fluid-impervious barrier layer (called hereafter "primary barrier") exposed to the interior of the container and supported by said thermally insulating material.

Such containers are useful for storing various fluid and solid substances, e.g., chemical substances and foodstuffs. The thermally insulating lining can have a sufficiently low thermal conductivity for keeping the contents of the container at sub-zero temperatures for long periods of time without the aid of refrigeration plant. The primary barrier can serve to prevent ingress of moisture into the interior of the container. This may be necessary, e.g., in the storage of certain foodstuffs. A more important function of the primary barrier is to contain the contents of the container in the case that they are of a fluid nature.

The invention is particularly but not exclusively intended for application to containers for storing liquids at cryogenic temperatures, say temperatures below 50°C., e.g. for storing liquified natural gas at substantially atmospheric pressure. When storing liquids at such temperatures it is crucial to prevent the liquid from leaking into contact with the structural shell if this is made of ordinary steel.

It has been proposed to make a cryogenic storage tank having a structural shell of ordinary steel, a thermally insulating lining and a primary barrier in the form of an inner membrane which is made of a special metal or alloy which is resistant to embrittlement at the low storage temperatures and which is fabricated to allow for the contraction and expansion which takes place with the filling and subsequent emptying of the tank. Such tanks are very expensive.

Another low temperature storage container which has been proposed comprises a primary barrier in the form of an inner plastics tank which is held against supporting insulation by the contents of the container when it is filled. There are serious disadvantages in this proposed construction. In particular it would be extremely difficult if not impossible to ensure that the inner plastics tank is at all times in use adequately supported notwithstanding the substantial contraction of the tank wall which takes place when it is cooled to sub-zero temperatures.

A further container construction previously proposed utilises a thermally insulating lining comprising panels of thermally insulating material covered on their inner faces by a layer of plastics which forms the primary barrier. The said plastics layer is connected to the inner faces of the thermally insulating panels by a layer of adhesive. The construction of a thermally insulating lining in that manner gives rise to very considerable difficulties because the forces imposed on the components of the lining on cooling and contraction thereof tend to tear the primary barrier away from the supporting insulating panels, to rupture the joints between the insulating panels and/or to rupture the panels themselves. The forces imposed by the mass of the container contents have of course also to be resisted. These problems are particularly in evidence in the case of a container which is of very large capacity and serves to hold substances at very low temperatures. By way of example containers for the storage of liquefied natural gas at land-based storage installations or in ocean-going cargo vessels may be required to have a capacity of 30,000 $m^3$ or more and to keep the contents at a temperature in the region of −165°C. for protracted periods of time. The forces imposed on the insulating lining in tanks of such specifications are very great.

It is an object of the present invention to provide a low temperature storage container incorporating a lining which is highly resistant to impairment by tensile stresses imposed during cooling of the interior of the container to temperatures substantially below atmospheric temperatures. The invention further aims to provide such a container which can be made without prohibitive expense to meet very stringent specifications such as are necessary in very large containers for the storage of liquefied natural gas (LNG) or liquefied petroleum gas (LPG) at atmospheric pressures.

According to the present invention there is provided a container for storing substances at sub-zero temperatures, said container comprising a structural shell having a lining incorporating thermally insulating material and a fluid-impervious barrier layer ("primary barrier") exposed to the interior of the container and supported by said thermally insulating material, characterised in that said primary barrier is constituted by a layer of plastics material which is of higher tensile strength than said thermally insulating material and forms part of a unitary cellular matrix which is directly or indirectly anchored to said shell, and in that the cells of said matrix contain the said insulating material or a least part of it.

In a container according to the invention, the tensile forces set up within and imposed upon the lining when the interior of the container is cooled are sustained by layers of plastics forming integral parts of a unitary cellular matrix. The plastics layers forming the cellular matrix include the primary barrier and at least one other fluid-impervious barrier layer disposed between that primary barrier and the structural shell, and mutually intersecting layers which interconnect such barrier layers and which lie in the direction of the thickness of the lining. The tensile forces can be very satisfactorily sustained by this unitary structure without impairment of the lining.

The cellular matrix should be directly or indirectly anchored to the structural shell over the whole projected area of the matrix in order to achieve a proper distribution of forces through the lining. Preferably the cellular structure is directly bonded over its whole projected area to the structural shell so that the cellular matrix and the advantages attendant on it are realised over the full thickness of the lining.

Another advantage of the invention is that the cellular matrix provides great security against leakage of contained fluid, e.g., liquefied gas, through to the structural shell, even if the primary barrier should fail at any point.

Preferably the matrix comprises at least two layers of cells within the thickness of the lining. In that case the matrix provides at least three fluid-impervious barriers between the interior of the container and the structural shell.

The number of cells per unit area of lining is a factor influencing the tensile strength of the lining. Assuming that the cells are substantially rectanguloid cells it is in general preferred to form cells measuring less than two meters in each direction in planes parallel to the primary barrier. This means that in a large capacity prismatic container there will be a multiplcity of cells in the or each layer of cells within the area of each major flat wall of the structural shell.

The invention is of course not restricted to prismatic containers.

The matrix material does not require to be rigid under the conditions of use. On the contrary the plastics layers composing the matrix are ideally thin and flexible and elastically extensible. By using thin layers e.g., layers less than 6mm in thickness, heat conduction to the interior of the container along the cell walls is restricted. The material or materials of the matrix must of course be selected so that each part of the matrix has the requisite tensile strength over the whole working temperature range. The primary barrier must have a high impact strength to withstand the stresses involved in rapid cooling of the interior of the container to temperatures well below −50°C and in some cases well below −100°C. The matrix material must of course also be chemically inert with respect to the substance to be stored in the container. These requirements point in particular to the use of synthetic elastomers for forming the cellular matrix. For the purposes primarily in view, the preferred materials in that category are to be found in particular in the class of polyurethane rubbers.

The loading forces imposed on the lining by the contents of the container (which forces are subject to widely varying distribution in the case of a container mounted or built into an ocean-going cargo vessel) are fully transmitted through the primary barrier to the supporting masses of thermally insulating material enclosed in the matrix cells, and thence to the structural shell. The thermally insulating material can be selected solely or primarily for its thermally insulating and load-bearing properties. Such material does not need to have a high tensile strength because it is substantially relieved of tensile forces by the cellular matrix. The preferred thermally insulating material is polyurethane foam. However various other types of insulating material can be used, including other plastics foams, solid insulating materials such as balsa wood and plywood, and granular material, e.g. mica and silica.

It is preferred to use a plastics thermally insulating material and to bring about chemical integration of such insulating material and the plastics layers forming the cellular matrix.

The layers of plastics for forming the cellular matrix can be formed in situ as the lining is built up e.g. by applying a polymerisable or curable polymeric composition under and between and over blocks of the selected thermally insulating material as they are laid, the polymerisable composition constituting a kind of mortar which is then polymerised and/or cured in situ. The invention includes a method of forming a thermally insulating lining within a structural shell to form a low temperatures storage container, characterised in that at least one elastomer skin-forming composition is applied internally of the shell so as progressively to form a cellular matrix, the matrix cells as, the lining is built up are filled with thermally insulating load-bearing material, and the said elastomer composition is cured or vulcanised in situ thereby to form an elastomer or elastomers having higher tensile strength than said thermally insulating material and to give said matrix a unitary structure which includes an innermost elastomer layer constituting a primary fluid-impervious barrier exposed to the storage space within the container.

While that method is satisfactory, there is another method which is very much more satisfactory and enables containers according to the invention to be manufactured more easily and cheaply. This alternative method, to which considerable importance is attached, makes use of prefabricated blocks each comprising a mass of thermally insulating material and an enveloping fluid-impervious plastics skin of higher tensile strength than such thermally insulating material. This alternative method, which also forms part of the present invention, is characterised in that one or more layers of such blocks is or are laid at the inside of the structural shell of the container with the aid of at least one bonding medium so that the said layer or the first of them if there is more than one is bonded to said shell and so that the blocks are bonded together thereby to integrate said skins into a unitary cellular matrix structure.

For bonding the blocks together use is preferably made of an adhesive composition via which vulcanisation or chemical cross-linking occurs between the blocks skins. In this way a substantially monolithic matrix structure is achieved, the matrix being of substantially uniform chemical composition across the joints. This feature is considered to be of great importance for achieving a lining with optimum properties well suited to large capacity containers for storing substances at very low sub-zero temperatures.

Various embodiments of the invention, selected by way of example, will now be described with reference to the accompanying drawings, in which:

FIG. 5 is a cross-section of part of the insulated shell of another container according to the invention; and FIG. 6 is a transverse cross-section of a double-hulled tanker having cargo containers according to the invention.

Figure 1:
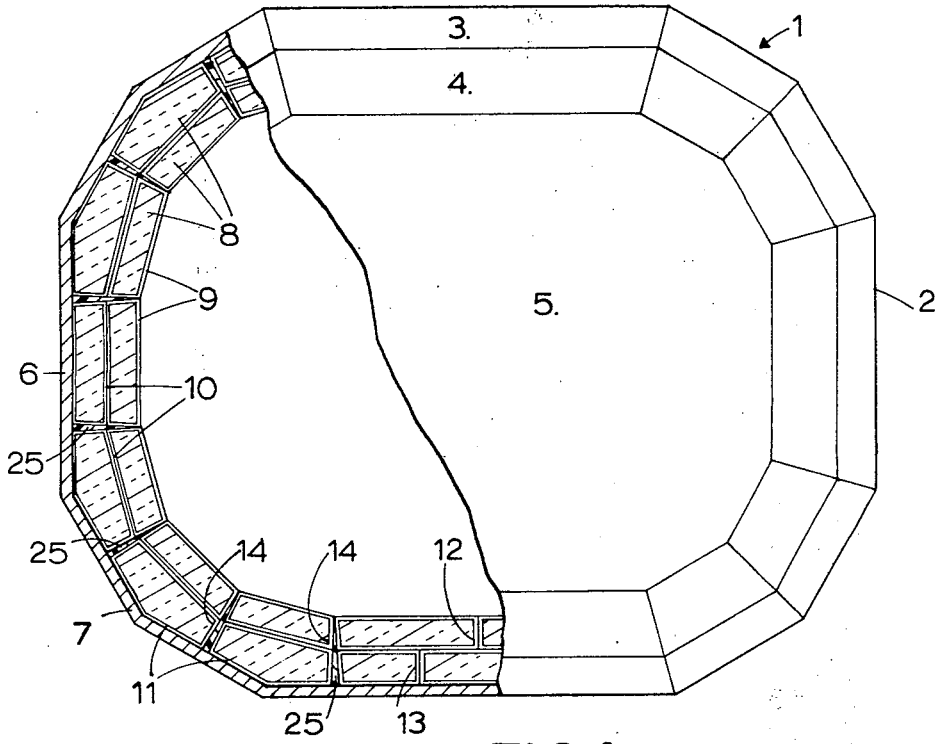
FIG. 1 is an end elevation of a low-temperature storage container partly broken away to show the lining structure.

The container 1 shown in FIG. 1 comprises a structural shell 2 formed by connecting flat plates of ordinary steel, e.g. Grade A or Grade D steel, such as 3, 4, 5, 6 and 7 so that the interior angles between adjacent wall portions of the shell are substantially greater than 90°.

The container is provided with a thermally insulating lining comprising masses such as 8 of thermally insulating material, and fluid-impervious barrier layers 9, 10 and 11. The barrier layer 9 is exposed to the storage space within the container and constitutes what is herein referred to as the primary barrier.

In accordance with the present invention, the primary barrier 9 is a plastics layer which forms an integral part of a unitary cellular matrix and the masses 8 of thermally insulating material are enclosed within the matrix cells. The matrix includes in addition to the primary barrier 9, the secondary and tertiary barrier layers 10 and 11, and a system of connecting layers or webs which extend between and interconnect the said barriers layers 9, 10 and 11. There are first series of such connecting layers substantially in planes paralled with the plane of the drawing and second series of such connecting layers substantially in planes normal to the plane of the drawing. The said second series include layers such as the layers 12 and 13 which extend between one barrier layer and the next, and layers such as 14 which extend through the full thickness of the lining between the barrier layers 9 and 11. The connecting layers such as 12 are in staggered relationship with respect to each other and to connecting layers such as 13 in the same way as the mortar joints in conventional brickwork.

The layers 14 taper in cross-section towards the primary barrier 9 and are disposed so as to meet such primary barrier along lines where planar portions thereof intersect to form an interior angle, and where in consequence the tensile forces in the primary barrier give rise to resultant inward tension vectors. The layers 14 can sustain such inward tension vectors. Their tapering cross-section provides a wide outer edge for bonding to the shell 2 but restricts cold losses due to heat conduction along such layers to the primary barrier 9.

In the container illustrated, the plastics layers forming the matrix are thin and resilient layers. Each of the barrier layers 9, 10 and 11 and the connecting layers 12 and 13 is less than 5 mm in thickness. The masses 8 of thermally insulating material are foamed plastics blocks, e.g., polyurethane foam blocks of various length and breadth dimensions ranging from 0.2m to 2m. Some of the blocks are rectanguloid, whereas others which bridge the interior angles of the shell 2, are of trapezoidal or pentagonal section. Each rectanguloid block has a thickness of about 10 cm.

The cellular matrix is preferably composed of one or more urethane rubbers. Urethane rubbers which are very satisfactory for the purpose in view are to be found among those marketed by E. I. DuPont de Nemours under the trade marks "Adiprene" and "Hytrel", e.g., "Adiprene L-167", "Adiprene L-200", "Adiprene L-420" and "Hytrel 5550".

The layers forming the cellular matrix can be formed in situ by applying, under and between and over the thermally insulating blocks, a prepolymer and coupling agent in appropriate proportions, or a curable liquid synthetic elastomer composition, and curing or vulcanising the composition in situ. For example urethane rubbers can be formed by reacting an unstable or stable isocyanate prepolymer with a chain extender. Thus a prepolymer can be obtained by reacting a polymer containing 5 to 20 tetramethylene ether glycol units with toluene di-isocyanate, such prepolymer then being subjected to inter- and intra-molecular polymerisation by means of a coupling agent, e.g. an ammino, polyamino or polyol compound. In an alternative method of forming urethane rubbers, a mixture of a suitable polyol, chain extender and catalyst is reacted with a di-isocyanate, so avoiding difficulties of handling a viscous prepolymer.

Figure 2:
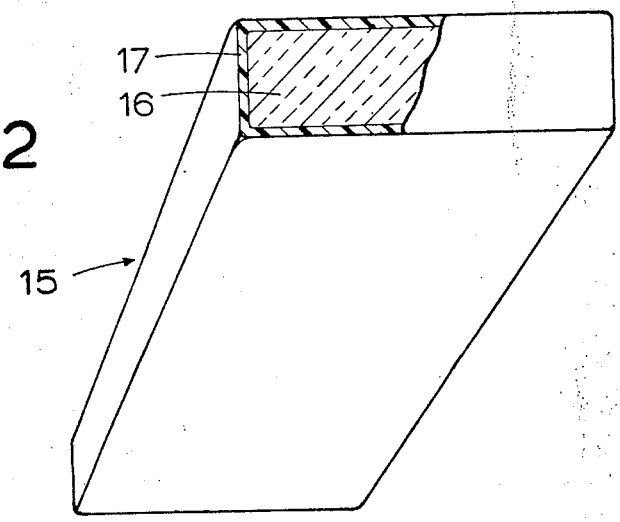
FIG. 2 is a perspective view of part of a thermally insulating block as used in building a container lining as represented in FIG. 1.

However, in the preferred method of lining fabrication, which was used in building the lining of the tank shown in FIG. 1, the lining is built from blocks of thermally insulating material individually enveloped in a fluid-impervious skin of a suitable elastomer such as one of the urethane rubbers hereinbefore referred to. A typical rectanguloid enveloped block is shown in FIG. 2. The block 15 comprises a body 16 of polyurethane foam enveloped by a fluid-impervious skin 17 of urethane rubber. While it is possible to produce an enveloped block as shown in FIG. 2 by applying and securing urethane rubber in sheet form to the body thermally insulating material, it is preferred to use a vacuum-forming or rotational moulding technique. For example the body 16 can be located within a mould by spacers which preserve around the said body a space into which the reaction mixture for forming the urethane rubber can be drawn so as to envelope the body 16. Alternatively an empty envelope of the elastomer can be rotationally moulded preparatory to injecting foamable polymer composition into the envelope so as to form the thermally insulating filling in situ. These techniques are well known to those concerned with industrial plastics-forming processes. When using a vacuum-forming process the body 16 of thermally insulating material can first be wrapped with some form of reinforcement, e.g., fibre-glass mat, so that the elastomer composition from which the skin 17 is formed is drawn through the reinforcement which thus becomes completely embedded.

Having provided the required number of enveloped blocks in the required shapes and sizes they are then laid up like brickwork within the shell 2 of the tank. For bonding the skin-enveloped blocks to the steel shell and for bonding adjacent enveloped blocks together, use is made of an adhesive based on a composition identical or similar to that used for forming the block skins and the adhesive composition is vulcanised. The vulcanisation of the adhesive between the enveloped blocks is attended by chemical cross-linking of the block skins to form layers such as 10, 12 and 13 which are of substantially uniform chemical composition and are integrated into a substantially monolithic matrix structure. For bonding urethane rubber skins an adhesive composition containing isoprene and a cross-linking agent can be used. In FIG. 1, well defined boundary lines have been drawn within the thickness of such layers. However, this is merely to indicate the way in which the individual enveloped blocks are assembled in constructing the lining. After bonding the blocks together as above described there are no such well defined boundaries. The matric layers are substantially homogeneous. Suitable urethane rubber adhesives not only integrate urethane rubber skins as above described but also give a very satisfactory bond between such urethane rubber skins and primed ordinary steel.

Figure 3:
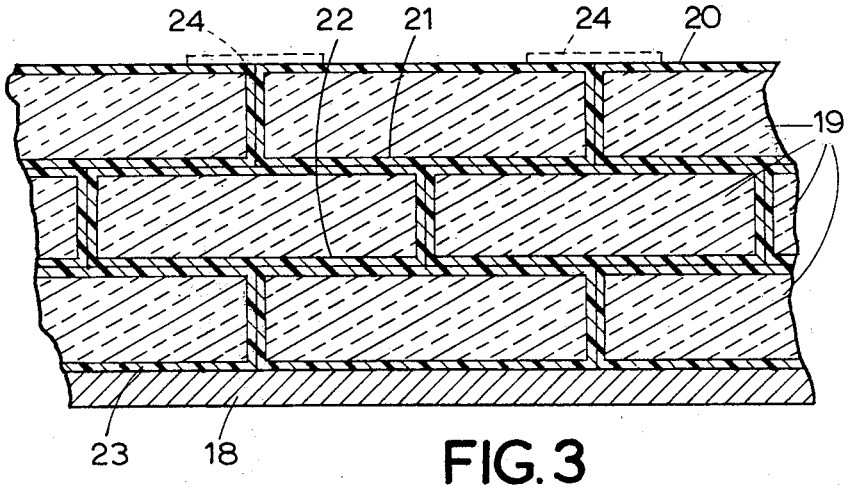
FIG. 3 is a cross-sectional elevation of part of a thermally insulating wall of another container according to the invention.

In the embodiment according to FIG. 1 the cellular matrix comprises two layers of cells. Any number of cell layers can be provided according to the requirements of a particular container as regards lining strength and efficiency of thermal insulation. FIG. 3 illustrates part of a container comprising a structural shell 18 having an adherent lining including a cellular matrix which defines three layers of cells occupied by masses such as 19 of thermal insulation, e.g. polystyrene or polyvinylchloride foam. The matrix provides a primary fluid-impervious barrier 20 and three further fluid-impervious barriers 21, 22 and 23. This lining has also been constructed from individually enveloped blocks as shown in FIG. 2.

In a further embodiment (not shown) a lining was formed comprising a cellular matrix prividing only one layer of cells.

If desired the lines of the joints between the blocks of the inner layer of blocks may be covered at the inner face of the lining by lapping strips which are bonded to the block skins forming the primary barrier. Two such lapping strips 24 are shown in broken line in FIG. 3. The strips are made of the same elastomer as the block skins forming the primary barrier layer 9 and they are also bonded in place by an adhesive which brings about chemical cross-linking so that the lapping strips in effect constitute parts of the primary barrier layer and constitute local thickenings thereof. Such lapping strips can of course also be employed in a lining as shown in FIG. 1.

It is not necessary to use the same elastomer for forming the whole of the cellular matrix. In some cases it is preferable to use different elastomers for different parts of the matrix. For example the skins of the enveloped blocks assembled in different layers of a lining may be composed of different elastomers with different elasticity modulus versus temperature curves. In this way account may be taken of the steep temperature gradient which will exist across the thickness of the lining when the primary barrier is cooled to a very low temperatures, e.g., of the order of −150°C. As another example, and as suggested by the boundary lines within the layers 14 in FIG. 1, these layers may incorporate wedge-section strips 25 between the adjacent block skins. Such strips 25 can be composed of an elastomer which is harder than the elastomer(s) forming the primary barrier and which is better able to sustain the tensile loading at the higher temperature levels which exist near the structural shell to which such strips are bonded.

Figure 4:
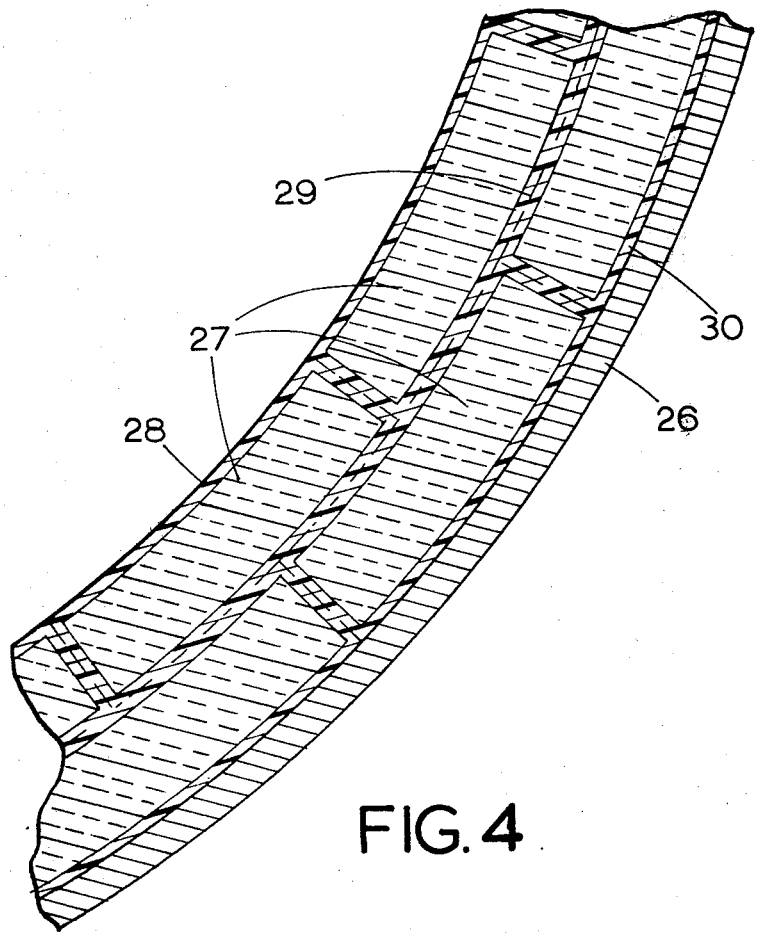
FIG. 4 is a cross-section of part of the insulated wall of a sperical container according to the invention.

FIG. 4 showns part of a sperical container according to the invention. The container comprises a spherical steel shell 26 and a unitary cellular matrix providing two layers of cells which are occupied by bodies 27 of plastics foam or other thermally insulating material. The matrix provides a primary barrier layer 28 which is exposed to the storage space within the container and two further fluid-impervious barrier layers 29 and 30. The lining can be built up in any of the ways hereinbefore described in relation to FIG. 1.

FIG. 5 shows part of a container comprising a steel shell 31 to which a thermally insulating layer 32 of wood, e.g., wood panels, is bonded. A plastics cellular matrix providing a primary fluid-impervious barrier layer 33 and a secondary fluid-impervious barrier 34 interconnected by layers or webs such as 35 is bonded by adhesive to the layer 32. Thus the matrix is indirectly secured to the steel shell 31. The matrix cells are occupied by blocks 36 of thermally insulating material such as polyvinylchloride foam. Reinforcing strips such as 37 are integrated with the primary barrier layer.

FIG. 6 is a transverse cross-section of a cargo vessel incorporating the invention. The vessel hull is of a double-skin type comprising an outer skin 38, and an inner skin 39. The inner skin 39 constitutes the structural shell of a cargo tank according to the invention for storing liquefied gas, e.g., liquefied natural gas. This skin is made of ordinary shipbuilding steel and is provided with a thermally insulating lining 40. The details of the lining are not shown but it is similar in all essential respects to the lining of the tank 1 shown in FIG. 1.

FIGS. 1 and 6 do not show the access openings of the containers. Such openings will normally be in the top wall and permit introduction of filling tubes, evacuation tubes and pumping equipment all as known per se in the relevant technological field.

The invention has been illustrated by containers bearing a structural shell of steel. Containers according to the invention can have structural shells of other materials. For example the invention can be carried out using a structural shell of concrete. Such a shell may be preferred for certain land-based storage installations. The shell may moreover, be of composite form comprising skins of different animals.

Other plastics materials having appropriate ductility impact resistance, co-efficient of thermal expansion and chemical inertness with respect to the substance to be stored, can be used in place of urethane elastomers for forming the cellular matrix.

We claim:

1. A container for storing substances at sub-zero temperatures, comprising a structural shell having a thermally insulating lining fixed thereto, said lining incorporating masses of thermally insulating load-bearing material and a monolithic matrix which is essentially composed of synthetic elastomeric material and defines a multiplicity of separate cells, which cells are occupied by said masses of thermally insulating material; said matrix comprising layers of synthetic elastomeric material forming uninterrupted fluid-impervious barriers which are disposed between the interior of said container and said shell and are mutually spaced apart depthwise of the lining, and said matrix also comprising layers of synthetic elastomeric material which extend depthwise of the lining between said barriers and divide the areas between such barriers into said separate cells.

2. A container according to claim 1, wherein said thermally insulating material is polymer foam and said matrix is composed of elastomeric material which is chemically integrated with said foam.

3. A container according to claim 1, wherein said monolithic matrix comprises three said fluid-impervious barriers which are disposed between the interior of said container and said shell and are mutually spaced apart depthwise of the lining, and the barrier nearest said shell is directly bonded thereto.

4. A container according to claim 1, wherein said layers of synthetic elastomeric material composing said monolithic matrix have a higher tensile strength than said thermally insulating material within the matrix cells, and wherein said layers have a higher degree of contraction than said thermally insulating material on cooling to sub-zero temperatures whereby said thermally insulating material is kept free from tensile stresses during such cooling.

5. A container for storing substance such as liquefied gas at sub-zero temperatures, comprising a structural shell having a lining incorporating thermally insulating material and fluid-impervious barriers, with the improvements that the lining incorporates at least three said fluid-impervious barriers which are spaced from each other and are formed by skins which constitute integral parts of a unitary cellular matrix essentially composed of synthetic elastomeric material; said matrix incorporates said skins and series of mutually intersecting tie webs which interconnect said barrier skins and sub-divide the spaces between those skins into a multiplicity of closed cells; said cells are coupled by masses of thermally insulating load-bearing material; and one of said barrier layers is directly bonded to said shell.

6. A container storing substances at sub-zero temperatures, comprising a structural shell having a thermally insulating lining fixed thereto, said lining incorporating masses of thermally insulating material and a matrix which is monolithic and is essentially composed of synthetic elastomeric material and defines a multiplicity of separate cells, which cells are occupied by said masses of thermally insulating material; said matrix comprising layers of synthetic elastomeric material forming fluid-impervious barriers which are disposed between the interior of said container and said shell and are mutually spaced apart depthwise of the lining, and said matrix also comprising layers of synthetic elastomeric material which extend depthwise of the lining between said barriers and divide the areas between such barriers into said separate cells; said lining having been built up from a multiplicity of blocks, each comprising a volume of said thermally insulating material pre-encapsulated in a skin of said synthetic elastomeric material, by laying such blocks in contiguous relationship in at least one layer inside said shell and uniting the skins of contiguous blocks over their entire mutually facing surfaces so as to form said monolithic cellular matrix.

7. A container according to claim 6, wherein said matrix comprises three said fluid-impervious barriers which are disposed between the storage space in said container and said shell and are mutually spaced apart depthwise of the lining; and wherein said layers of synthetic elastomeric material composing said monolithic matrix have a higher tensile strength than said thermally insulating material within the matrix cells and have a higher degree of contraction than said thermally insulating material on cooling to sub-atmospheric temperatures whereby said thermally insulating material is kept free from tensile stresses during such cooling; said lining having been built up from a multiplicity of blocks, each comprising a volume of said thermally insulating material pre-encapsulated in a skin of said synthetic elastomeric material, by layer such blocks in contiguous relationship in at least two layers inside said shell and uniting the skins of contiguous blocks over their entire mutually facing surfaces thereby to integrate such skins and thus form said monolithic cellular matrix.

8. A container for storing substances at sub-zero temperatures comprising a structural shell having a thermally insulating lining fixed thereto, said lining comprising a plurality of thermal insulating blocks, each of said blocks being encapsulated with a synthetic elastomeric material, and wherein said encapsulated blocks are within the container in a contiguous relationship in at least one layer inside said shell, said elastomeric material for said blocks being bonded to said shell along the surface of said blocks adjacent thereto and to contiguous blocks over their entire mutually facing surfaces thereby forming said encapsulated blocks into a thermally insulating lining wherein the elastomeric material is formed into a monolithic matrix and the elastomeric material facing the interior of said container forms an uninterrupted primary barrier surface, wherein said primary barrier surface is at all positions spaced from said shell.

* * * * *